US009297143B2

(12) United States Patent
Murakami et al.

(10) Patent No.: US 9,297,143 B2
(45) Date of Patent: Mar. 29, 2016

(54) CONSTRUCTION MACHINE WITH MANUALLY-OPERATED UNIT

(71) Applicant: KOBELCO CONSTRUCTION MACHINERY CO., LTD., Hiroshima-shi (JP)

(72) Inventors: Masayuki Murakami, Hiroshima (JP); Hideyuki Okura, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/557,782

(22) Filed: Dec. 2, 2014

(65) Prior Publication Data

US 2015/0159345 A1 Jun. 11, 2015

(30) Foreign Application Priority Data

Dec. 6, 2013 (JP) ..... 2013-253436

(51) Int. Cl.

| | |
|---|---|
| ***E02F 9/20*** | (2006.01) |
| ***E02F 9/08*** | (2006.01) |
| ***E02F 9/22*** | (2006.01) |

(52) U.S. Cl.

CPC ..... *E02F 9/0833* (2013.01); *E02F 9/0875* (2013.01); *E02F 9/2012* (2013.01); *E02F 9/2271* (2013.01); *E02F 9/2275* (2013.01)

(58) Field of Classification Search

CPC ..... E02F 9/2271; E02F 9/0875; E02F 9/2275; E02F 9/2012; E02F 9/0833

See application file for complete search history.

(56) References Cited

U.S. PATENT DOCUMENTS 5,232,330 A * 8/1993 Rae ..... E02F 3/6273 414/686
7,726,435 B2 * 6/2010 Nakayoshi ..... E02F 9/0875 180/315

(Continued)

FOREIGN PATENT DOCUMENTS

JP 2-22482 6/1990
JP 10-96248 A 4/1998

(Continued)

OTHER PUBLICATIONS

Office Action issued Oct. 27, 2015 in Japanese Patent Application No. 2013-253436 (with English Translation).

*Primary Examiner* — Gerald McClain
(74) *Attorney, Agent, or Firm* — Oblon, McClelland, Maier & Neustadt, L.L.P.

(57) ABSTRACT

Provided is a construction machine which is capable of disposing a manually-operated unit at a position where it can be manually operated by a worker located around an upper slewing body, while suppressing an increase in size of the upper slewing body in a horizontal direction. The manually-operated unit comprises a unit body, and a rotary lever attached with respect to the unit body in such a manner as to be rotatable about a preset rotational axis, in a posture where it extends beyond an outer peripheral surface of the unit body in a direction perpendicular to the rotational axis. A fuel tank has an undersurface opposed to the bottom plate, and a lower-outer lateral surface extending upwardly from the undersurface in such a manner as to face an outer edge portion side of a bottom plate. The unit body is disposed above the bottom plate and beneath the undersurface of the fuel tank, in a posture where the rotational axis extends approximately horizontally. The rotary lever is disposed outward of a lower edge portion of the lower-outer lateral surface of the fuel tank, so as to permit rotation of the rotary lever.

12 Claims, 8 Drawing Sheets

(56) References Cited

U.S. PATENT DOCUMENTS

| | | | | |
|---|---|---|---|---|
| 2006/0108309 | A1* | 5/2006 | Sato | E02F 3/325 212/232 |
| 2008/0005937 | A1 | 1/2008 | Nakayoshi et al. | |
| 2008/0035401 | A1 | 2/2008 | Ishii et al. | |
| 2010/0019104 | A1 | 1/2010 | Ichimura et al. | |
| 2014/0360354 | A1* | 12/2014 | Kurushima | E02F 9/0875 92/145 |

FOREIGN PATENT DOCUMENTS

| | | | | |
|---|---|---|---|---|
| JP | 2000096626 | A | * | 4/2000 |
| JP | 2001-040702 | A | | 2/2001 |
| JP | 2006097341 | A | * | 4/2006 |
| JP | 2008031817 | A | * | 2/2008 |
| JP | 2009-024395 | A | | 2/2009 |
| JP | 2010-031490 | A | | 2/2010 |

* cited by examiner

CONSTRUCTION MACHINE WITH MANUALLY-OPERATED UNIT

BACKGROUND OF THE INVENTION

1. Field of the Invention

The present invention relates to a construction machine such as a hydraulic shovel.

2. Description of the Background Art

Heretofore, there has been known a construction machine comprising: a lower traveling body, an upper slewing body slewably provided on the lower traveling body, and a working attachment displaceably provided with respect to the upper slewing body.

This construction machine includes a known type equipped with a manually-operated unit configured to be manually operated by a worker (for example, a manipulation pattern switching valve described in Japanese Examined Utility Model Publication No. H02-22482).

The manually-operated unit described in Japanese Examined Utility Model Publication No. H02-22482 is interposed in a hydraulic circuit for driving a working attachment, to change a correspondence relationship between an operation direction of a working attachment manipulation lever and a movement of the working attachment.

Specifically, the manually-operated unit comprises a unit body (a casing and a rotary spool), and a rotary lever (switching lever) attached with respect to the unit body in such a manner as to be rotatable about a given rotational axis, in a posture where it extends beyond an outer peripheral surface of the unit body in a direction perpendicular to the rotational axis.

Recent years, there has been an increasing need to dispose the manually-operated unit at a position where it can be manually operated by a worker located around the upper slewing body.

For this purpose, it is conceivable to shift a device provided on the upper slewing body, in a horizontal direction, to thereby provide a space for installing the manually-operated unit, on the side of an outer surface side of the upper slewing body.

In this case, however, there is a problem that the upper slewing body is undesirably increased in size in the horizontal direction due to a need to ensure an installation space for the device shifted in the horizontal direction.

In particular, the rotary lever extends beyond the outer peripheral surface of the unit body. Thus, when the manually-operated unit is disposed in such a manner that a rotational trajectory plane of the rotary lever is oriented outwardly along the horizontal direction, the manually-operated unit requires an installation space greater than that for the unit body, in the horizontal direction.

SUMMARY OF THE INVENTION

It is an object of the present invention to provide a construction machine capable of disposing a manually-operated unit at a position where it can be manually operated by a worker located around an upper slewing body, while suppressing an increase in size of the upper slewing body in a horizontal direction.

In order to achieve the above object, the present invention provides a construction machine which comprises a lower traveling body, an upper slewing body slewably provided on the lower traveling body, and a working attachment displaceably attached with respect to the upper slewing body, wherein the upper slewing body comprises a bottom plate slewably attached onto the lower traveling body, a device provided on the bottom plate, and a manually-operated unit capable of being manually operated, and wherein: the manually-operated unit comprises a unit body, and a rotary lever attached with respect to the unit body in such a manner as to be rotatable about a preset rotational axis, in a posture where the rotary lever extends beyond an outer peripheral surface of the unit body in a direction perpendicular to the rotational axis; and the device has an undersurface opposed to the bottom plate, and an outer lateral surface extending upwardly from the undersurface in such a manner as to face an outer edge portion side of the bottom plate, and wherein: the unit body is disposed above the bottom plate and beneath the undersurface of the device, in a posture where the rotational axis extends approximately horizontally; and the rotary lever is disposed outward of a lower edge portion of the outer lateral surface of the device, so as to permit rotation of the rotary lever.

The present invention makes it possible to dispose the manually-operated unit at a position where it can be manually operated by a worker located around the upper slewing body, while suppressing an increase in size of the upper slewing body in a horizontal direction.

DETAILED DESCRIPTION OF THE PREFERRED EMBODIMENTS OF THE INVENTION

With reference to the accompanying drawings, the present invention will now be described based on embodiments thereof. It is to be understood that the following description is made to exemplify some embodiments of the present invention and is not intended to limit the scope of the present invention.

First Embodiment

Figure 1:
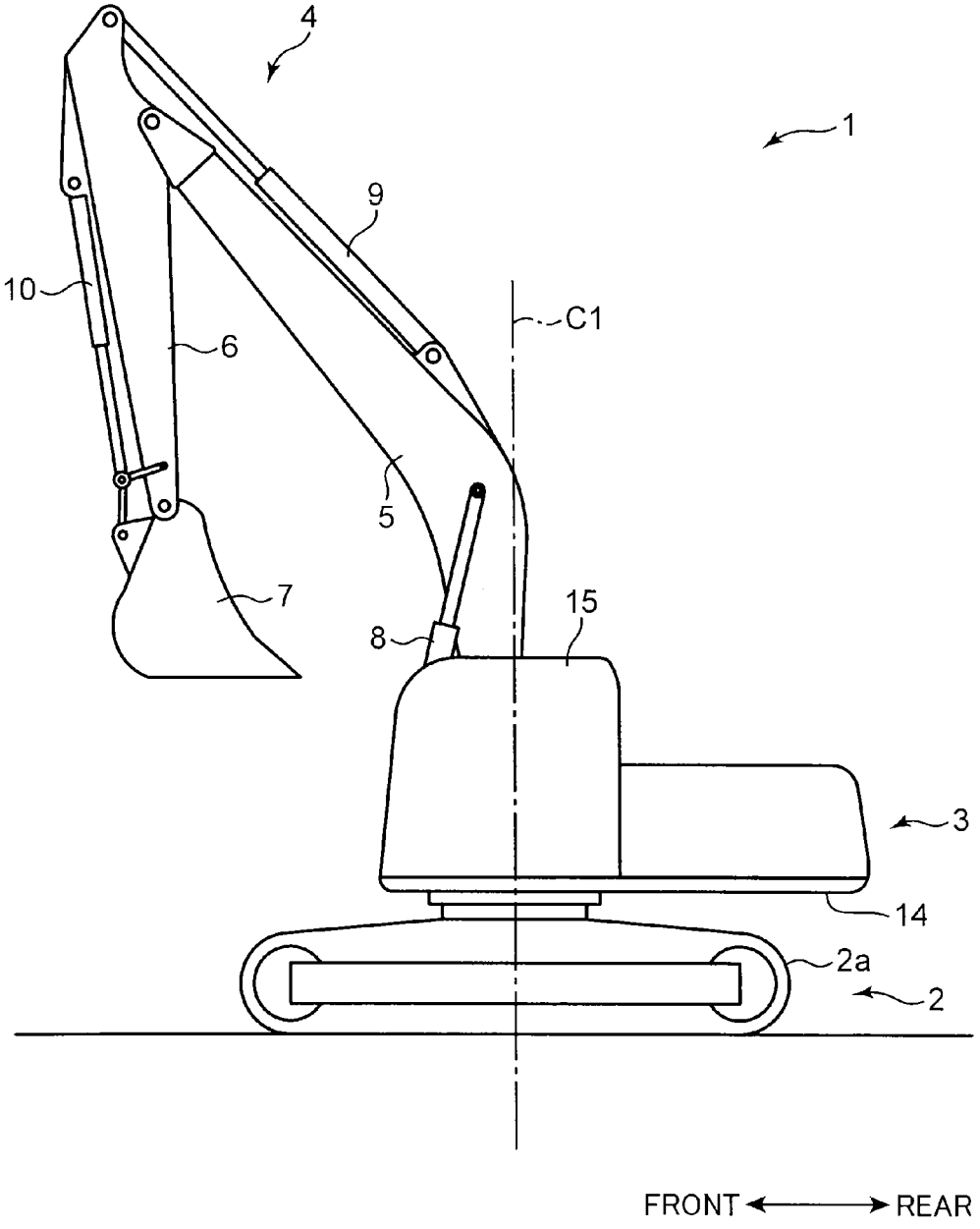
FIG. 1 is a left side view illustrating an overall configuration of a hydraulic shovel according to a first embodiment of the present invention.

FIG. 1 is a left side view illustrating a hydraulic shovel 1 as one example of a construction machine according to a first embodiment of the present invention.

The hydraulic shovel 1 comprises: a self-propelled lower traveling body 2 having a crawler 2*a*; an upper slewing body 3 provided on the lower traveling body 2 slewably about a slewing axis C1; and a work attachment 4 displaceably attached with respect to the upper slewing body 3. The following description will be made using directions as viewed from an operator located inside an aftermentioned operator's cab 15. The slewing axis C1 is an axis along an up-down direction.

The working attachment 4 includes a boom 5 raisably and lowerably attached with respect to the upper slewing body 3, an arm 6 swingably attached with respect to a distal end portion of the boom 5, and a bucket 7 swingably attached with respect to a distal end portion of the arm 6.

The work attachment 4 also includes a boom cylinder 8 for raising and lowering the boom 5 with respect to the upper slewing body 3, an arm cylinder 9 for swingingly driving the arm 6 with respect to the boom 5, and a bucket cylinder 10 for swingingly driving the bucket 7 with respect to the arm 6.

Figure 2:
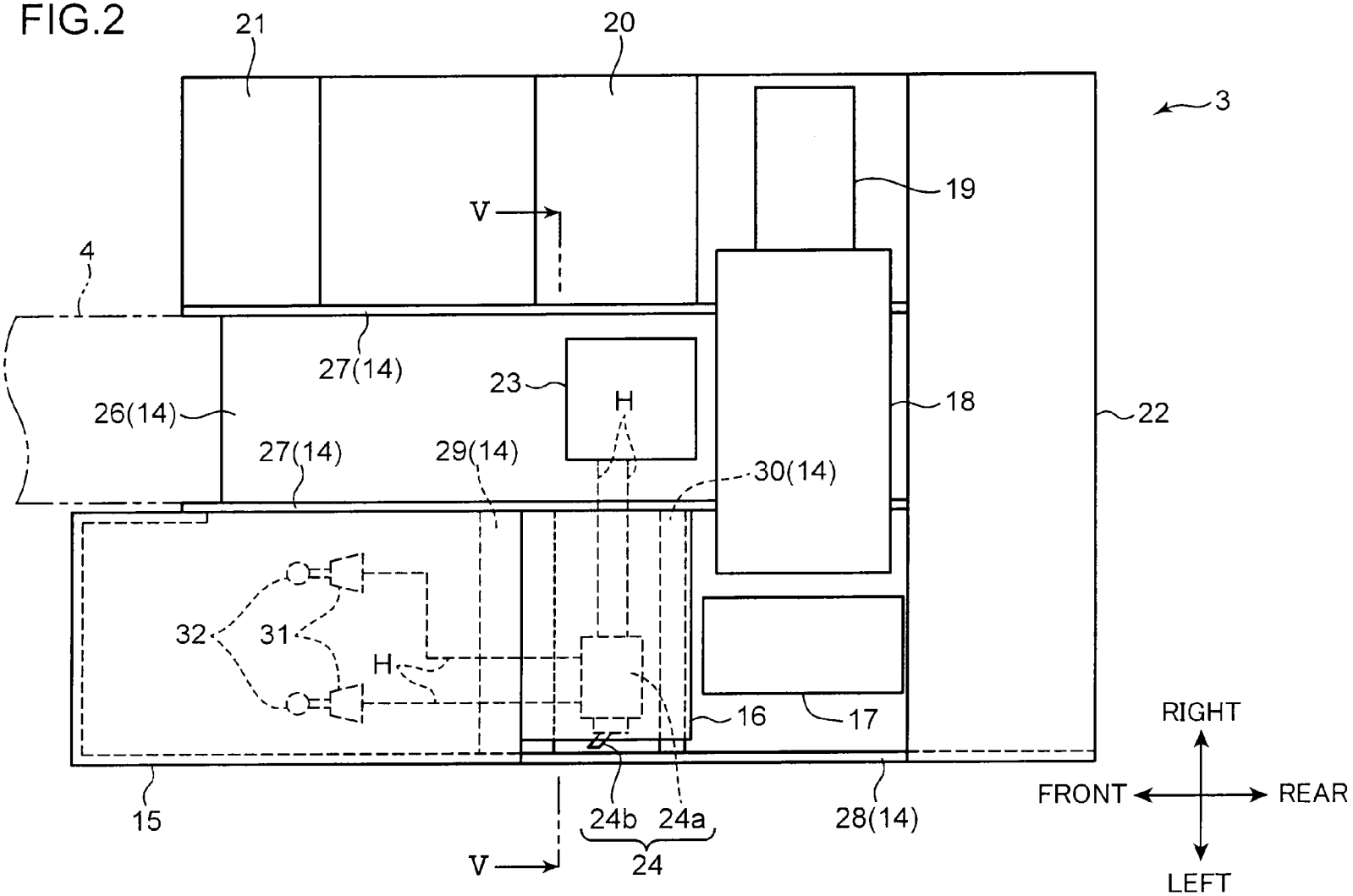
FIG. 2 is a top plan schematic diagram of an upper slewing body of the hydraulic shovel illustrated in FIG. 1.
Figure 5:
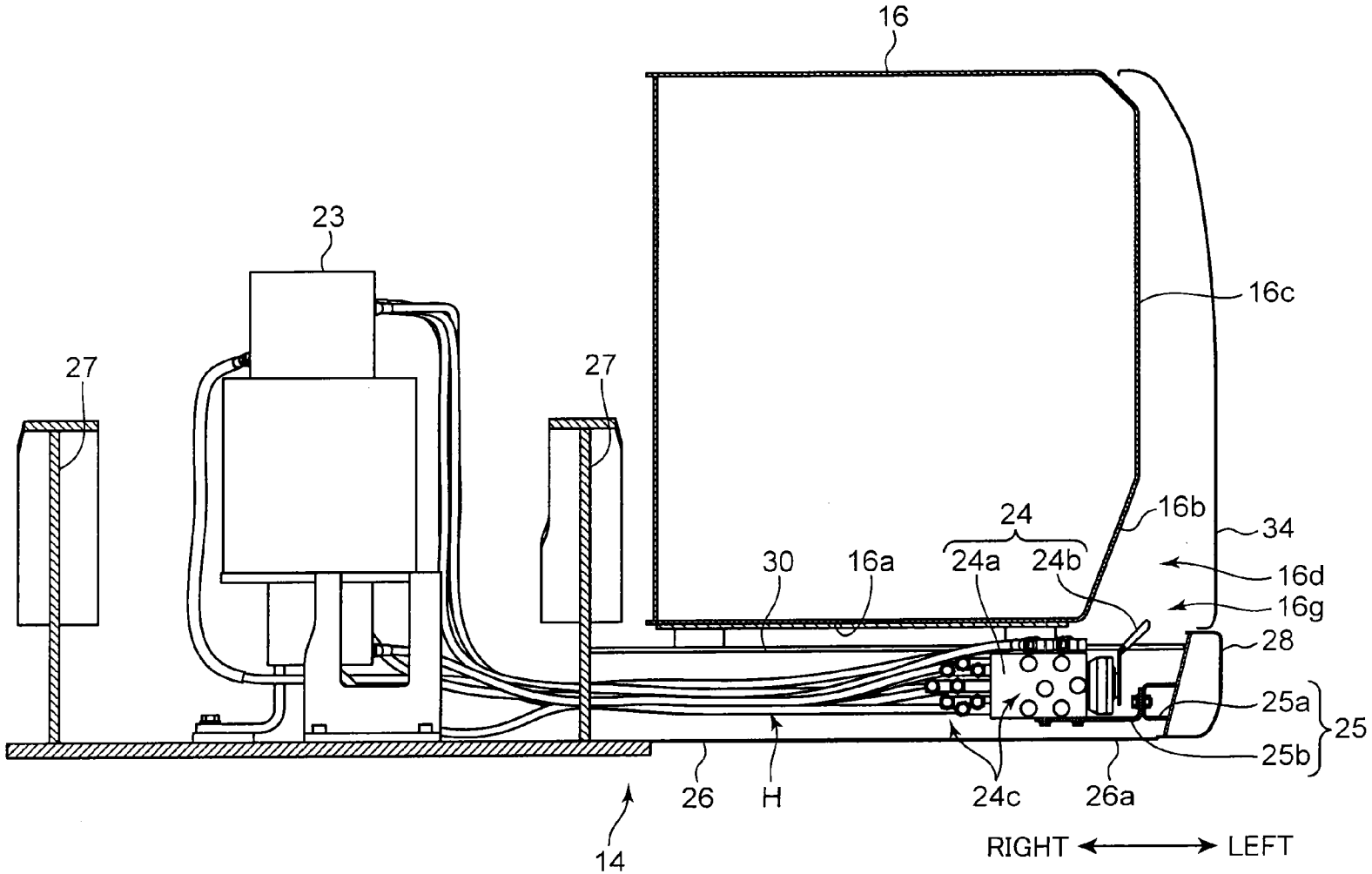
FIG. 5 is a sectional view taken along the line V-V in FIG. 2.

Referring to FIGS. 1 and 2, the upper slewing body 3 comprises an upper frame 14, and components (devices) provided on the upper frame 14, such as an operator's cab 15, a fuel tank 16, a cooling device 17, an engine 18, a hydraulic pump 19, a hydraulic oil tank 20, a storage housing 21, a counterweight 22, a control valve (control device) 23, a manually-operated valve (manually-operated unit) 24, and a valve attaching mechanism 25 (see FIG. 5).

FIG. 2 is illustrated by omitting a cover member covering the components (except for the operator's cab 15 and the counterweight 22) provided on the upper frame 14, from upper and lateral sides thereof.

Figure 4:
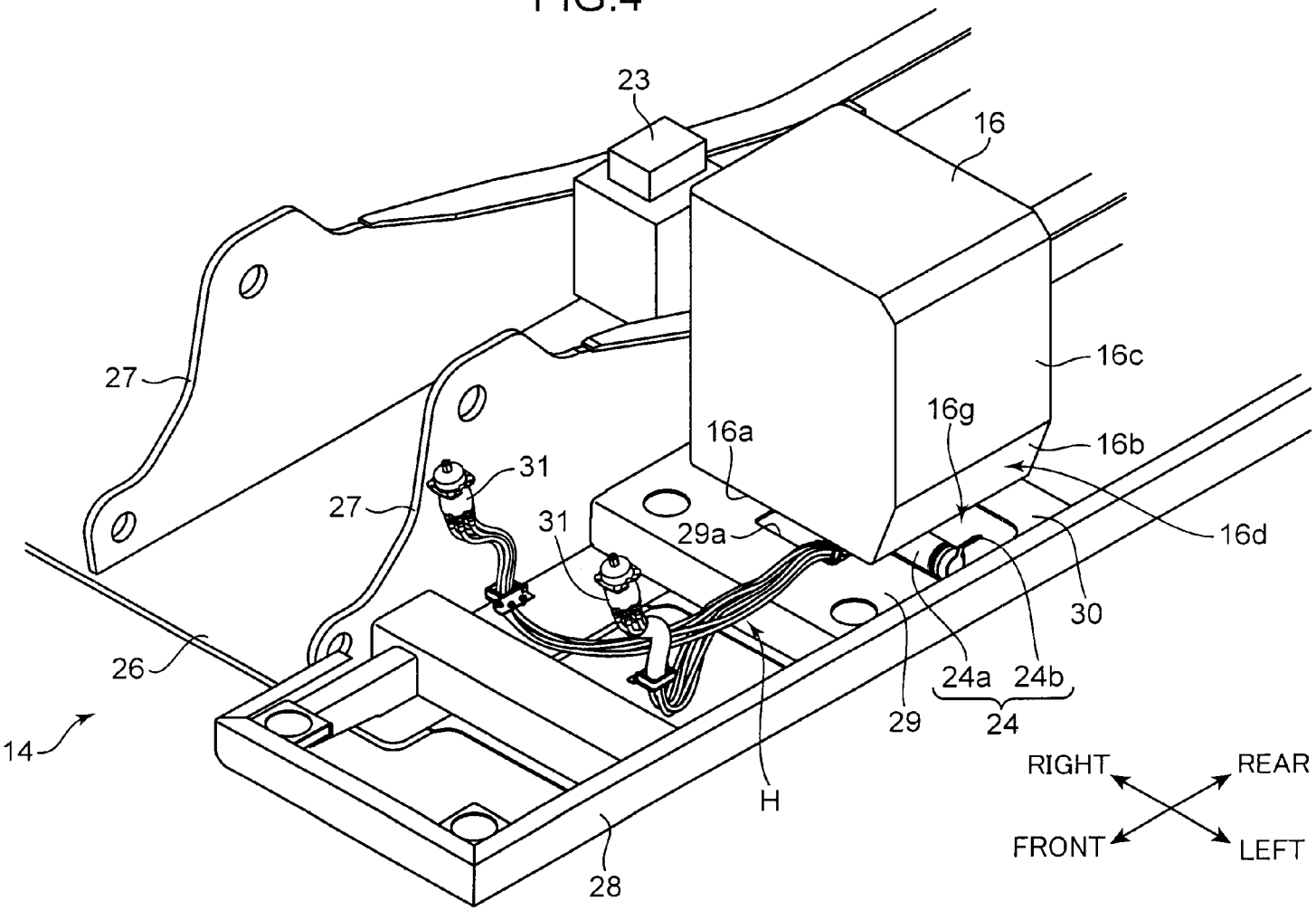
FIG. 4 is a schematic perspective view enlargedly illustrating a front region of an upper frame illustrating in FIG. 2.

Referring to FIGS. 2 and 4, the upper frame 14 comprises: a bottom plate 26 slewably attached with respect to the lower traveling body 2; a pair of right and left vertical plates 27 each provided to stand upwardly on the bottom plate 26 and extend in a front-rear direction in a right-left directional approximately central region of the bottom plate 26; a reinforcement member 28 provided along an outer edge portion of the bottom plate 26; and a front pedestal 29 and a rear pedestal 30 provided on the bottom plates 26 at a position leftward of the left vertical plate 27 and arranged side-by-side in the front-rear direction.

Here, a layout of the components provided on the upper frame 14 will be described.

The operator's cab 15 is provided on a front region of the bottom plate 26 at a position leftward of the left vertical plate 27.

The fuel tank 16 is provided leftward of the left vertical plate 27 and rearward of the operator's cab 15

The cooling device 17 is provided leftward of the left vertical plate 27 and rearward of the fuel tank 16.

The engine 18 is disposed to extend from the cooling device 17 to a position rightward of the right vertical plate 27, in such a manner that a longitudinal direction of the engine 18 is aligned with the right-left direction, and supported on the right and left vertical plates 27.

The hydraulic pump 19 is disposed to extend rightwardly from a right end portion of the engine 18.

The hydraulic oil tank 20 is provided rightward of the right vertical plate 27 and forward of the hydraulic pump 19. The storage housing 21 is provided rightward of the right vertical plate 27 and forward of the hydraulic oil tank 20

The counterweight 22 is provided rearward of the cooling device 17, the engine 18 and the hydraulic pump 19, over the entire width of the upper frame 14 in the right-left direction.

The control valve 23 is provided forward of the engine 18 and between the right and left vertical plates 27.

Each of the manually-operated valve 24 and the valve attaching mechanism 25 is provided beneath the fuel tank 16 and above the bottom plate 26, as described in detail later.

The operator's cab 15 is equipped with a pair of remote control valves (instruction output means) 31 each configured to output a pilot pressure (actuation instruction for the working attachment) to the control valve 23, and a pair of manipulation levers 32 for operating the respective remote control valves 31.

Figure 6:
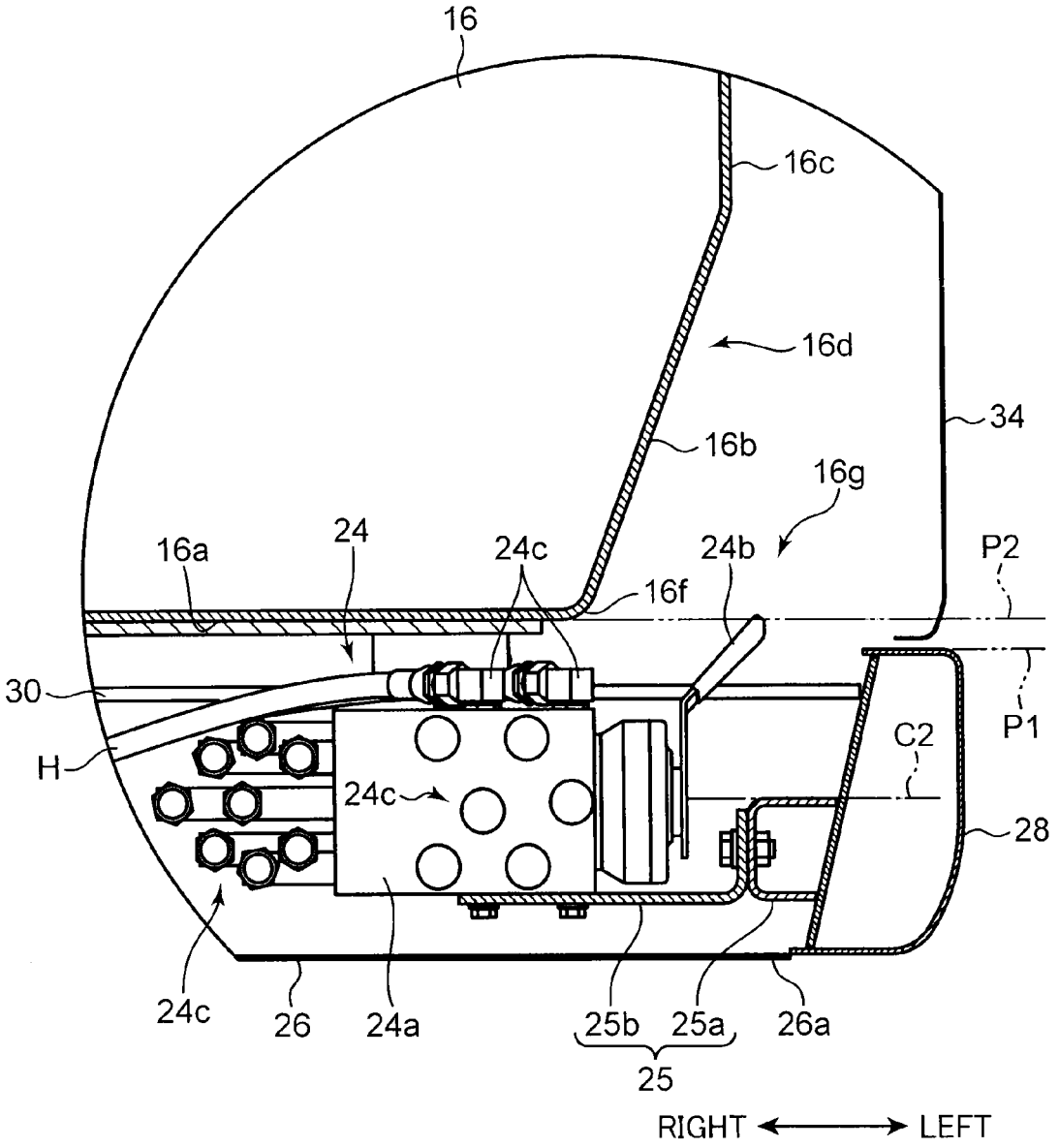
FIG. 6 is an enlarged view of a part of FIG. 5.

Referring to FIGS. 2 and 6, the manually-operated valve 24 comprises a valve body (unit body) 24*a* connected to each of the remote control valves 31 via a pipe line (connection line), H and a rotary lever 24*b* attached with respect to the valve body 24*a* in such a manner as to be rotatable about a rotational axis C2, in a posture where the rotary lever 24*b* extends beyond an outer peripheral surface of the valve body 24*a* in a direction perpendicular to the rotational axis C2.

The valve body 24*a* has a plurality of pipe connector portions 24*c* for allowing a plurality of pipe lines H to be connected, respectively, thereto. In FIG. 6, for the sake of simplification of illustration, as regards the plurality of pipe lines H located around the valve body 24*a*, illustration of a part of the pipe lines H on the front side of FIG. 6 is omitted, and only a part of the pipe connector portions 24*c* to which the part of the pipe lines H are connected are illustrated.

The manually-operated valve 24 is configured to change an output destination of the pilot pressure output from each of the remote control valves 31 to the control valve 23 (a correspondence relationship between the actuation instruction and a movement content of the working attachment 4), according to rotation of the rotary lever 24*b*. The valve body 24*a* is connected to the control valve 23 via the pipe lines H.

Figure 3:
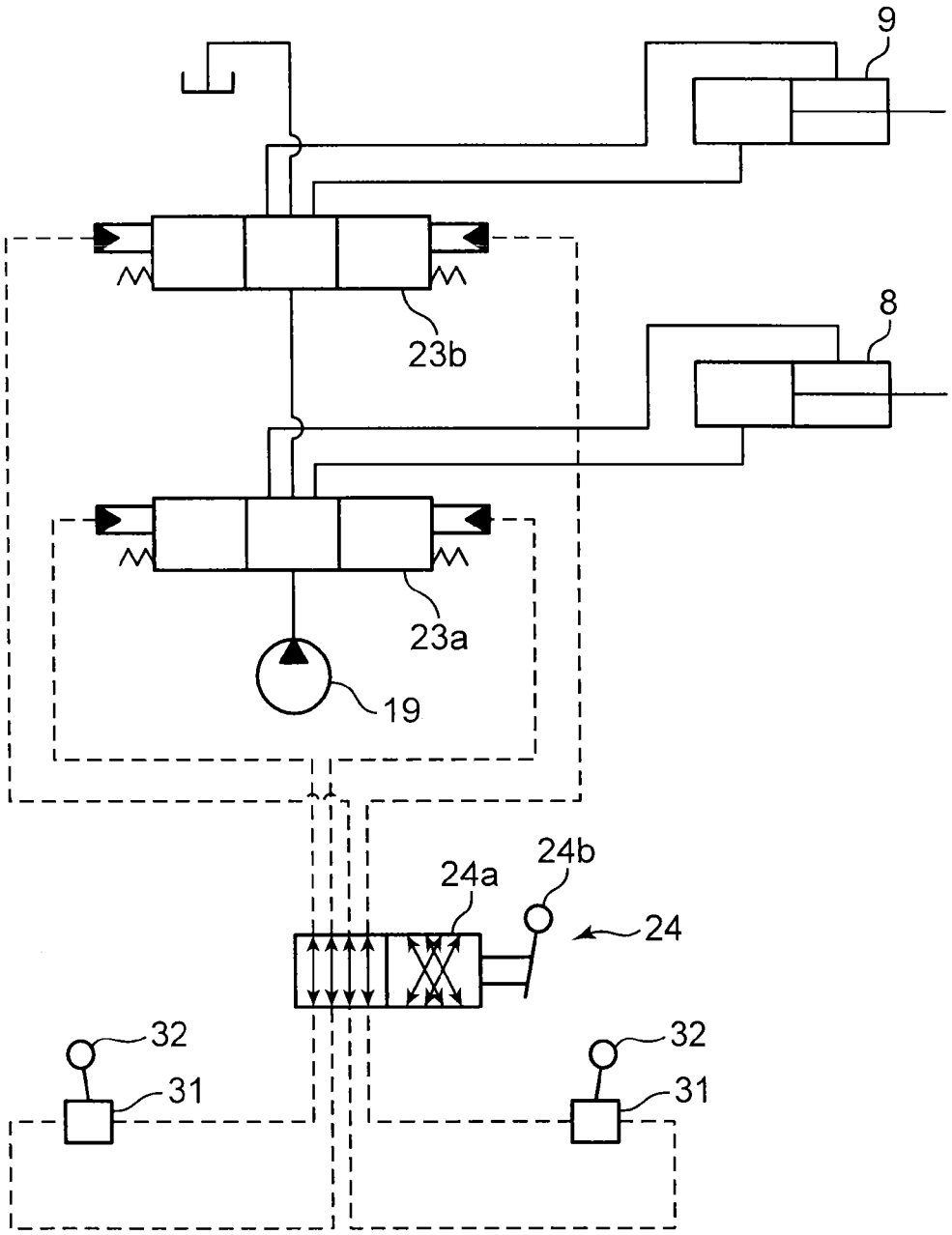
FIG. 3 is a circuit diagram for explaining a function of a manually-operated valve illustrated in FIG. 2.

With reference to FIG. 3, a function of the manually-operated valve 24 will be described below. FIG. 3 illustrates examples of a boom spool 23*a* and an arm spool 23*b* of the control valve 23. The following description will be made by taking, as an example, an operation for changing a supply destination of the pilot pressure from each of the remote control valves 31 between the spool 23*a* and the spool 23*b*.

The valve body 24*a* of the manually-operated valve 24 has a plurality of (in FIG. 3, two) switchable positions corresponding to the number of the pilot pressure supply destinations to be changed.

Specifically, in a first position illustrated in FIG. 3, the left remote control valve 31 is connected to the boom spool 23*a*, and the right remote control valve 31 is connected to the arm spool 23*b*.

On the other hand, when the rotary valve 24*b* is rotated to set the valve body 24*a* to a second position illustrated on a right side of FIG. 3, the left remote control valve 31 is connected to the arm spool 23*b*, and the right remote control valve 31 is connected to the boom spool 23*a*.

In this way, the correspondence relationship between the pilot pressure from each of the remote control valves 31 and the movement content of the working attachment 4 is changed according to a rotational operation of the rotary lever 24*b*.

As illustrated in FIGS. 2, 4 and 5, the above the manually-operated valve 24 is disposed beneath the fuel tank 16.

The fuel tank 16 is attached on the front pedestal 29 and the rear pedestal 30 each provided on the bottom plate 26 of the upper frame 14.

The front and rear pedestals 29, 30 are provided as a means to partially raise a height position of the bottom plate 26. Specifically, the front and rear pedestals 29, 30 are configured such that upper surfaces thereof are located at approximately the same height positions, and arranged in spaced-apart relation to each other in the front-rear direction.

The manually-operated valve 24 is disposed between the front and rear pedestals 29, 30 and beneath the fuel tank 16.

The pipe lines H between the pair of remote control valves 31 and the valve body 24*a* of the manually-operated valve 24 are led from above the front pedestal 29 into a space beneath the fuel tank 16 through a communication hole 29*a* (see FIG. 4) formed in an upper wall of the front pedestal 29.

Further, the pipe lines H between the valve body 24*a* of the manually-operated valve 24 and the control valve 23 are led rightwardly from a position leftward of the left vertical plate 27 through a non-illustrated through-hole formed in the left vertical plate 27.

With reference to FIG. 6, a configuration of the valve attaching mechanism 25 will be described below.

The valve attaching mechanism 25 is fixed to an inner surface (right surface) of the reinforcement member 28 of the upper frame 14. In the first embodiment, the reinforcement member 28 is a tubular-shaped member fixed to a left outer edge portion 26*a* of the bottom plate 26, in such a manner as to overlap the rotary lever 24*b* from a left side thereof (thereoutside).

The valve attaching mechanism 25 secures the valve body 24*a* of the manually-operated valve 24 to the upper frame 14 while supporting the valve body 24*a* from therebelow.

Specifically, the valve attaching mechanism 25 comprises a fixed member 25*a* fixed to the inner surface of the reinforcement member 28, and a bracket 25*b* attached to the fixed member 25*a*.

The bracket 25*b* has an attached portion attached to the fixed member 25*a*, and a support portion extending rightwardly from a lower end portion of the attached portion. The valve body 24*a* is attached onto the support portion by a bolt.

With reference to FIGS. 4 and 6, a relationship between the manually-operated valve 24 and the fuel tank 16 will be described below.

The manually-operated valve 24 is disposed in a posture where the rotational axis C2 thereof extends approximately parallel to the right-left direction. Further, as regards the rotary lever 24*b* of the manually-operated valve 24, a rotatable range thereof about the rotational axis C2 includes a sub-range in which a distal end portion of the rotary lever 24*b* passes through a region above the rotational axis C2. Specifically, in the first embodiment, on the basis of a rotational position where the rotary lever 24*b* is in an upright state, the rotary lever 24*b* is rotatable in a range between about 70 degrees toward a front side and about 70 degrees toward a rear side.

Correspondingly, the fuel tank 16 has a lower portion defining a cutout region 16*d* for ensuring a permissible space 16*g* which permits the rotation of the rotary lever 24*b*. This permissible space 16*g* includes not only a space for allowing a rotational movement of the rotary lever 24*b* to be performed, while avoiding interference between the rotary lever 24*b* and the fuel tank 16, but also a space for allowing a worker to grip the rotary lever 24*a* by his/her hand, while avoiding interference with the fuel tank 16.

Specifically, the fuel tank 16 has: an upper-outer lateral surface 16*c* facing the left outer edge portion 26*a* side of the bottom plate 26; a lower-outer lateral surface 16*b* extending obliquely downwardly and inwardly from a lower edge portion of the upper-outer lateral surface 16*c*; and an undersurface 16*a* extending approximately horizontally and inwardly from a lower edge portion 16*f* of the lower-outer lateral surface 16*b*. The cutout region 16*d* is defined by the lower-outer lateral surface 16*b*. The undersurface 16*a* is fixed onto the front pedestal 29 and the rear pedestal 30.

That is, the fuel tank 16 has the undersurface 16*a* opposed to the bottom plate 26, and the lower-outer lateral surface 16*b* ("outer lateral surface" set forth in the appended claims) extending upwardly from the undersurface 16*a* in such a manner as to face the left outer edge portion 26*a* side of the bottom plate 26.

Then, the valve body 24*a* of the manually-operated valve 24 is disposed above the bottom plate 26 and beneath the undersurface 16*a* of the fuel tank 16. Further, the rotary lever 24*b* is disposed leftward (outward) of the lower edge portion 16*f* of the lower-outer lateral surface 16*b* of the fuel tank 16.

Thus, it becomes possible to ensure the permissible space 16*g* for permitting the rotation of the rotary lever 24*b*, on a left side of the lower-outer lateral surface 16*b* (in the cutout region 16*d*). In FIG. 6, the reference sign 34 denotes a cover member covering the fuel tank 16 from the left side thereof. A worker located leftward of the fuel tank 16 can access the permissible space 16*g* by opening a part or an entirety of the cover member 34.

A portion of the fuel tank 16 located upward of the cutout region 16*d* (a portion of the fuel tank 16 having the upper-outer lateral surface 16*c*) protrudes leftwardly (outwardly) with respect to the lower-outer lateral surface 16*b*. Therefore, this portion can be utilized to increase a capacity of the fuel tank 16.

The distal end portion of the rotary lever 24*b* extends leftwardly (outwardly) toward a distal edge side thereof. This makes it easy for a worker located leftward of the bottom plate 26 to manually operate the rotary lever 24*b*.

The lower-outer lateral surface 16*b* of the fuel tank 16 is disposed rightward (inward) of the reinforcement member 28. This makes it possible to provide a space for accessing the rotary lever 24*b*, between the lower-outer lateral surface 16*b* and the reinforcement member 28.

In the first embodiment, a height position P1 of an upper end of the reinforcement member 28 is set to be located below a height position P2 of the undersurface 16*a* of the fuel tank 16, so that it becomes possible to facilitate access to the rotary lever 24*b* while effectively utilizing the permissible space 16*g* in the cutout region 16*d* defined by the lower-outer lateral surface 16*b*.

As described above, the valve body 24*a* of the manually-operated valve 24 is provided beneath the fuel tank 16, so that it becomes possible to dispose the valve body 24*a* on the bottom plate 26, while suppressing the need to shift the fuel tank 16 in a horizontal direction.

In a state in which the valve body 24*a* is disposed in a posture where the rotational axis C2 extends approximately horizontally, the rotary lever 24*b* is provided outward of the lower edge portion 16*f* of the lower-outer lateral surface 16*b* of the fuel tank 16, so that a space located above the rotary lever 24*b* opened from the undersurface 16*a* of the fuel tank 16 can be utilized as a rotatable range of the rotary lever 24*b*. Thus, the rotary lever 24*b* can be disposed at a position where it can be manually operated by a worker located adjacent to the outer edge portion 26*a* of the bottom plate 26.

This makes it possible to dispose the manually-operated valve 24 at a position where it can be manually operated by a worker located around the upper slewing body 3, while suppressing an increase in size of the upper slewing body 3 in the horizontal direction.

The hydraulic shovel 1 according to the first embodiment can also bring out the following advantageous effects.

A portion of the fuel tank 16 other than the lower-outer lateral surface 16*b* (a portion of the fuel tank 16 having the upper-outer lateral surface 16*c*) protrudes outwardly with respect to the lower-outer lateral surface 16*b*, so that it becomes possible to increase a storage volume of the fuel tank 16, in a region other than the permissible space 16*g* for the rotation of the rotary lever 24*b*.

The distal end portion of the rotary lever 24*b* extends leftwardly (outwardly) toward a distal edge thereof, so that a position of the distal end portion of the rotary lever 24*b* comes closer to the outer edge portion 26*a* of the bottom plate 26.

This makes it easier for a worker located adjacent to the outer edge portion 26*a* of the bottom plate 26 to manually operate the rotary lever 24*b*.

Further, in conformity to the shape of the distal end portion of the rotary lever 24*b*, the lower-outer lateral surface 16*b* of the fuel tank 16 extends obliquely upwardly and leftwardly (outwardly) from the lower edge portion 16*f* thereof, so that the storage volume of the fuel tank 16 can also be increased in the portion of the of the fuel tank 16 formed with the lower-outer lateral surface 16*b*.

The reinforcement member 28 is provided along the outer edge portion 26*a* of the bottom plate 26, so that it becomes possible to satisfy both weight reduction and ensuring of strength of the bottom plate 26.

On the other hand, the reinforcement member 28 is fixed to the outer edge portion 26*a* of the bottom plate 26, in such a manner as to overlap the rotary lever 24*a* from the left side thereof (thereoutside). This imposes restriction on access to the rotary lever 24*b* from the left side thereof.

Therefore, in the first embodiment, the lower-outer lateral surface 16*b* of the fuel tank 16 is disposed rightward (inward) of the reinforcement member 28, so that access to the rotary lever 24*b* from thereabove through a gap between the lower-outer lateral surface 16*b* of the fuel tank 16 and the reinforcement member 28 is permitted.

This makes it possible to facilitate reinforcement and weight reduction of the bottom plate 26 while permitting a worker located around the bottom plate 26 to manually operate the manually-operated valve 24.

In the first embodiment, the manually-operated valve 24 configured to change the correspondence relationship between the pilot pressure from each of the remote control valves 31 and a movement content of the working attachment 4 is disposed rearward of the operator's cab 15.

Thus, when an operator in the operator's cab 15 intends to change the corresponding relationship, the operator can manually operate the manually-operated valve 24 immediately after getting out of the operator's cab 15.

Second Embodiment

The first embodiment has been described based on an example in which the fuel tank is formed to define the cutout region 16*d*. Alternatively, the cutout region 16*d* may be omitted.

Figure 7:
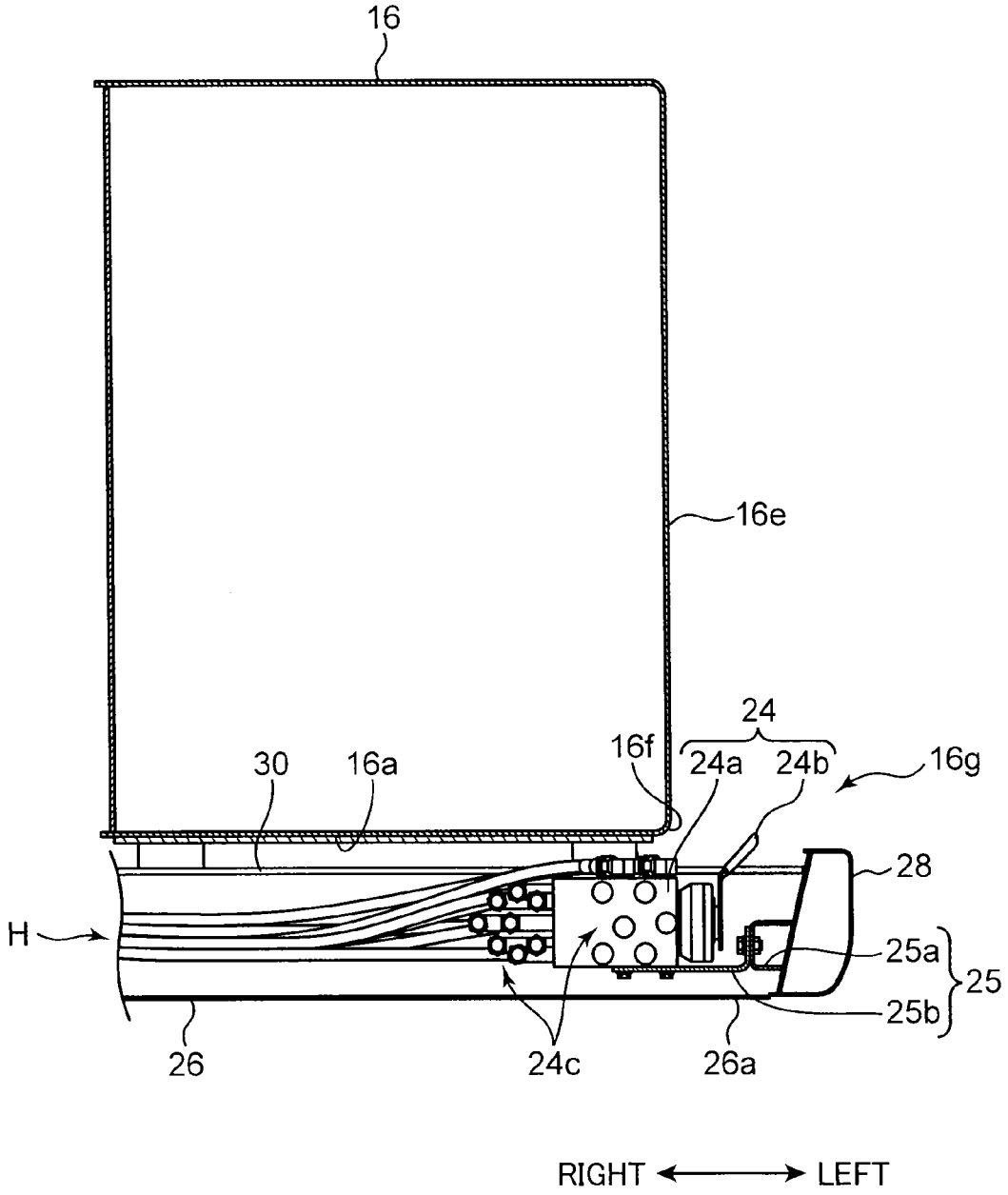
FIG. 7 is a front sectional view of a construction machine according to a second embodiment of the present invention.

As illustrated in FIG. 7, in a construction machine according to a second embodiment of the present invention, a fuel tank 16 has a horizontally-extending undersurface 16*a*, and a lateral surface 16*e* extending approximately vertically upwardly from the undersurface 16*a*.

A right-left directional position of a lower edge portion 16*f* of the lateral surface 16*e* is identical to a right-left directional position of the lower edge portion 16*f* in the first embodiment.

Thus, a permissible space 16*g* for permitting rotation of a rotary lever 24*b* can be provided leftward (outward) of the lateral surface 16*e*.

Third Embodiment

In the first and second embodiments, the valve body 24*a* of the manually-operated valve 24 is disposed adjacent to the outer edge portion 26*a* of the bottom plate 26. Alternatively, the valve body 24*a* may be disposed more inwardly (more rightwardly).

Figure 8:
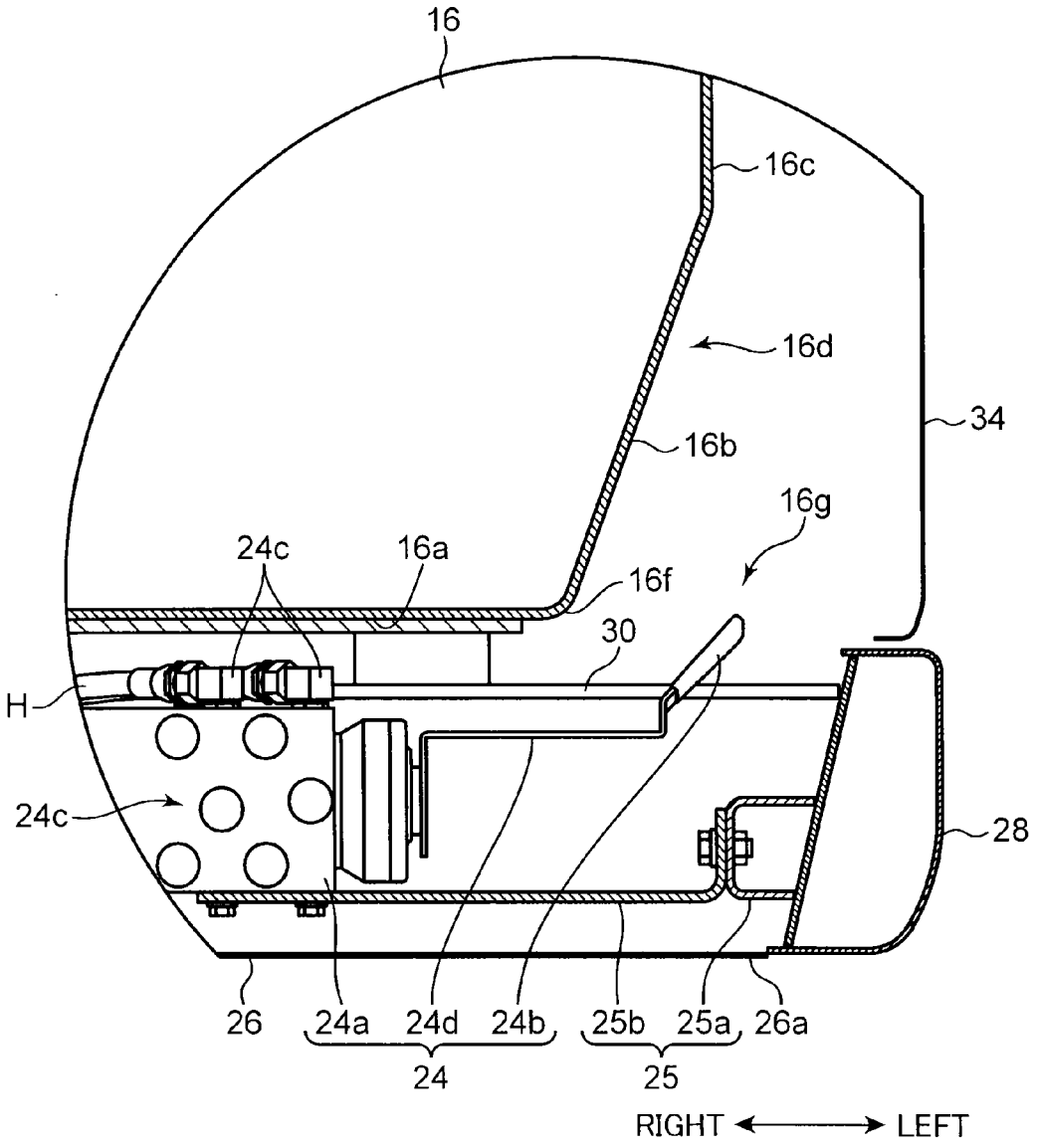
FIG. 8 is a view corresponding to FIG. 6 and illustrating a construction machine according to a third embodiment of the present invention.

As illustrated in FIG. 8, in a construction machine according to a third embodiment of the present invention, the manually-operated valve 24 further comprises a coupling portion 24*d* extending rightwardly (inwardly) from the rotary lever 24*b* to couple the rotary lever 24*b* and the valve body 24*a* together, so as to allow a rotational movement of the rotary lever 24*b* to be transmitted to the valve body 24*a*.

The coupling portion 24*d* allows the valve body 24*a* to be disposed more rightwardly, so that a distance between the valve body 24*a* and the control valve 23 can be reduced to shorten a length of each of the pipe lines H connecting therebetween. This makes it possible to reduce pressure loss occurring in hydraulic oil to thereby facilitate energy saving.

In the above embodiments, the fuel tank 16 is exemplified as a device disposed above the manually-operated valve 24. Alternatively, the hydraulic oil tank 20, an aqueous urea solution tank (not illustrated) or the storage housing 21 may be employed as the device.

Further, in the above embodiments, the manually-operated valve 24 is exemplified as a manually-operated unit. Alternatively, a selector valve for switching between flow passages to an attachment may be employed as the manually-operated unit.

The aforementioned specific embodiments include an invention having the following features.

Specifically, the present invention provides a construction machine which comprises a lower traveling body, an upper slewing body slewably provided on the lower traveling body, and a working attachment displaceably attached with respect to the upper slewing body, wherein the upper slewing body comprises a bottom plate slewably attached onto the lower traveling body, a device provided on the bottom plate, and a manually-operated unit capable of being manually operated, and wherein: the manually-operated unit comprises a unit body, and a rotary lever attached with respect to the unit body in such a manner as to be rotatable about a preset rotational axis, in a posture where the rotary lever extends beyond an outer peripheral surface of the unit body in a direction perpendicular to the rotational axis; and the device has an undersurface opposed to the bottom plate, and an outer lateral surface extending upwardly from the undersurface in such a manner as to face an outer edge portion side of the bottom plate, and wherein: the unit body is disposed above the bottom plate and beneath the undersurface of the device, in a posture where the rotational axis extends approximately horizontally; and the rotary lever is disposed outward of a lower edge portion of the outer lateral surface of the device, so as to permit rotation of the rotary lever.

In the construction machine of the present invention, the unit body of the manually-operated unit is provided beneath the device, so that it becomes possible to dispose the unit body on the bottom plate, while suppressing the need to shift the device in a horizontal direction.

Further, in a state where the rotational axis extends approximately horizontally, the rotary lever is provided outward of the lower edge portion of the outer lateral surface of the device, so that a space located above the rotary lever opened from the undersurface of the device can be utilized as a rotatable range of the rotary lever. Thus, the rotary lever can be disposed at a position where it can be manually operated by a worker located adjacent to the outer edge portion of the bottom plate.

Thus, the present invention makes it possible to dispose the manually-operated unit at a position where it can be manually operated by a worker located around the upper slewing body, while suppressing an increase in size of the upper slewing body in the horizontal direction.

As used in this specification, the term "the rotary lever is disposed outward of a lower edge portion of the outer lateral surface of the device, so as to permit rotation of the rotary lever" means that not only a space for allowing a rotational movement of the rotary lever to be performed, while avoiding interference between the rotary lever and the device, but also a space for allowing a worker to grip the rotary lever by his/her hand, while avoiding interference with the device, are defined outward of the outer lateral surface of the device In this regard, the above outer lateral surface may be formed on the entire lateral portion of the device facing the outer edge portion side of the bottom plate. In this case, however, the device has restriction on size, even in a portion free of interference with the rotary lever during the rotational movement. Thus, when a storage container is employed as the device, it will have restriction on storage volume.

Therefore, in the case where a storage container internally having a storage chamber is employed as the device, it is preferable that the outer lateral surface of the device is located inward of a permissible space which permits the rotation of the rotary lever, and a lateral portion of the device facing the outer edge portion side of the bottom plate is formed with a protruding portion protruding outwardly with respect to the outer lateral surface in a region other than the permissible space.

According to this aspect, a storage volume of the device can be increased in a region other than the permissible space for the rotation of the rotary lever.

It should be noted that the term "permissible space" means only a space for allowing a rotational movement of the rotary lever to be performed, while avoiding interference between the rotary lever and the device, but also a space for allowing a worker to grip the rotary lever by his/her hand, while avoiding interference with the device.

Preferably, in the above construction machine, the rotary lever has a distal end portion extending outwardly toward a distal edge of the rotary lever, and the outer lateral surface extends obliquely upwardly and outwardly from the lower edge portion of the outer lateral surface.

According to this aspect, a position of the distal end portion of the rotary lever comes closer to the outer edge portion of the bottom plate, so that it becomes easier for a worker located adjacent to the outer edge portion of the bottom plate to manually operate the rotary lever.

Further, in conformity to the shape of the distal end portion of the rotary lever, the outer lateral surface can be formed to extend obliquely upwardly and outwardly so as to define the permissible space, so that the storage volume of the device can also be increased in the portion of the of the device formed with the outer lateral surface.

In order to satisfy both weight reduction and ensuring of strength of the bottom plate, a reinforcement member may be provided along the outer edge portion of the bottom plate. However, when the reinforcement member is provided in such a manner as to overlap the rotary lever from thereoutside, access to the rotary lever from thereoutside will be restricted.

Therefore, in the case where the upper slewing body is provided with a reinforcement member fixed to the outer edge portion of the bottom plate, in such a manner as to overlap the rotary lever from outside of the rotary lever, and configured to reinforce the bottom plate, the outer lateral surface of the device is preferably disposed inward of the reinforcement member.

According to this aspect, access to the rotary lever from thereabove is permitted through a gap between the outer lateral surface of the device and the reinforcement member.

This makes it possible to facilitate reinforcement and weight reduction of the bottom plate while permitting a worker located around the bottom plate to manually operate the manually-operated unit.

Preferably, in the above construction machine, the upper slewing body further comprises an operator's cab provided on the bottom plate, an instruction output means provided inside the operator's cab and configured to output an actuation instruction for the working attachment, and wherein: the manually-operated unit is configured to change a correspondence relationship between the actuation instruction from the instruction output means and a movement content of the working attachment, according to a rotational operation of the rotary lever; and the device and the manually-operated unit are disposed rearward of the operator's cab.

According to this aspect, the manually-operated unit configured to change the correspondence relationship between the actuation instruction from the instruction output means and a movement content of the working attachment is disposed rearward of the operator's cab.

Thus, when an operator in the operator's cab intends to change the corresponding relationship, the operator can manually operate the manually-operated unit immediately after getting out of the operator's cab.

Preferably, in the above construction machine, the upper slewing body further comprises a control device configured to control a movement of the working attachment, in response to an input of the actuation instruction from the manually-operated unit after the change of the correspondence relationship, wherein the control device is disposed inward of the unit body, and connected to the unit body via a connection line so as to allow the actuation instruction from the manually-operated unit to be transmitted to the control device, and the manually-operated unit further comprises a coupling portion extending inwardly from the rotary lever to couple the rotary lever and the unit body together, so as to allow a rotational movement of the rotary lever to be transmitted to the unit body.

According to this aspect, the unit body can be disposed more inwardly using the coupling portion, while fixing a position of the rotary lever, so that it becomes possible to shorten a length of the connection line connecting between the unit body and the control device.

This application is based on Japanese Patent application No. 2013-253436 filed in Japan Patent Office on Dec. 6, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A construction machine comprising:

a lower traveling body;

an upper slewing body slewably provided on the lower traveling body, and a working attachment displaceably attached with respect to the upper slewing body, wherein the upper slewing body comprises a bottom plate slewably attached onto the lower traveling body, a device provided on the bottom plate, and a manually-operated unit capable of being manually operated, and wherein:

the manually-operated unit comprises a unit body, and a rotary lever attached with respect to the unit body in such a manner as to be rotatable about a preset rotational axis, in a posture where the rotary lever extends beyond an outer peripheral surface of the unit body in a direction perpendicular to the rotational axis; and the device has an undersurface opposed to the bottom plate, and an outer lateral surface extending upwardly from the undersurface in such a manner as to face an outer edge portion side of the bottom plate, and wherein:

the unit body is disposed above the bottom plate and beneath the undersurface of the device, in a posture where the rotational axis extends approximately parallel to the surface of the bottom plate and laterally outward; and the rotary lever is disposed outward of a lower edge portion of the outer lateral surface of the device, so as to permit rotation of the rotary lever.

2. The construction machine according to claim 1, wherein the device is a storage container internally having a storage chamber, and wherein:

the outer lateral surface of the device is located inward of a permissible space which permits the rotation of the rotary lever; and a lateral portion of the device facing the outer edge portion side of the bottom plate is formed with a protruding portion protruding outwardly with respect to the outer lateral surface in a region other than the permissible space.

3. The construction machine according to claim 2, wherein the rotary lever has a distal end portion extending outwardly toward a distal edge of the rotary lever, and the outer lateral surface extends obliquely upwardly and outwardly from the lower edge portion of the outer lateral surface.

4. The construction machine according to claim 1, wherein the upper slewing body further comprises a reinforcement member fixed to the outer edge portion of the bottom plate, in such a manner as to overlap the rotary lever from outside of the rotary lever, and configured to reinforce the bottom plate, and wherein the outer lateral surface of the device is disposed inward of the reinforcement member.

5. The construction machine according to claim 1, wherein the upper slewing body further comprises an operator's cab provided on the bottom plate, an instruction output means provided inside the operator's cab and configured to output an actuation instruction for the working attachment, and wherein:

the manually-operated unit is configured to change a correspondence relationship between the actuation instruction from the instruction output means and a movement content of the working attachment, according to a rotational operation of the rotary lever; and the device and the manually-operated unit are disposed rearward of the operator's cab.

6. The construction machine according to claim 5, wherein the upper slewing body further comprises a control device configured to control a movement of the working attachment, in response to an input of the actuation instruction from the manually-operated unit after the change of the correspondence relationship, the control device is disposed inward of the unit body, and connected to the unit body via a connection line so as to allow the actuation instruction from the manually-operated unit to be transmitted to the control device, and the manually-operated unit further comprises a coupling portion extending inwardly from the rotary lever to couple the rotary lever and the unit body together, so as to allow a rotational movement of the rotary lever to be transmitted to the unit body.

7. The construction machine according to claim 1, wherein a permissible space which permits the rotation of the rotary lever is formed outward of the lower edge portion of the outer lateral surface of the device.

8. The construction machine according to claim 7, wherein:

the device is a storage container internally having a storage chamber;

a lateral portion of the device facing the outer edge portion side of the bottom plate is formed with a protruding portion protruding outwardly with respect to the outer lateral surface; and the permissible space is formed outward of the lower edge portion of the outer lateral surface of the storage container and below the protruding portion.

9. The construction machine according to claim 8, wherein:

the rotary lever has a distal end portion extending outwardly toward a distal edge of the rotary lever;

the outer lateral surface of the storage container extends obliquely upwardly and outwardly from the lower edge portion of the outer lateral surface; and the permissible space is formed outward of the lower edge portion of the outer lateral surface of the storage container.

10. The construction machine according to claim 7, wherein:

the upper slewing body further comprises a reinforcement member fixed to the outer edge portion of the bottom plate, in such a manner as to overlap the rotary lever from outside of the rotary lever, and configured to reinforce the bottom plate; and the permissible space is formed outward of the lower edge portion of the outer lateral surface of the device and inward of the reinforcement member.

11. The construction machine according to claim 7, wherein:

the upper slewing body further comprises an operator's cab provided on the bottom plate, and an instruction output means provided inside the operator's cab and configured to output an actuation instruction for the working attachment;

the manually-operated unit is configured to change a correspondence relationship between the actuation instruction from the instruction output means and a movement content of the working attachment, according to a rotational operation of the rotary lever;

the device and the manually-operated unit are disposed rearward of the operator's cab; and the permissible space is formed rearward of the operator's cab and outward of the lower edge portion of the outer lateral surface of the device.

12. The construction machine according to claim 11, wherein:

the upper slewing body further comprises a control device configured to control a movement of the working attachment, in response to an input of the actuation instruction from the manually-operated unit after the change of the correspondence relationship;

the control device is connected to the unit body via a connection line so as to allow the actuation instruction from the manually-operated unit to be transmitted to the control device;

the device and the manually-operated unit are disposed outward of the control device;

the manually-operated unit further comprises a coupling portion extending inwardly from the rotary lever to couple the rotary lever and the unit body together, so as to allow a rotational movement of the rotary lever to be transmitted to the unit body; and the permissible space is formed outward of the control device and outward of the lower edge portion of the outer lateral surface of the device.

* * * * *